US005779494A

United States Patent [19]

Ito et al.

[11] Patent Number: 5,779,494

[45] Date of Patent: Jul. 14, 1998

[54] CONNECTOR WITH REINFORCED LATCH

[75] Inventors: Yoshikazu Ito; Satoshi Sueoka, both of Yamato, Japan

[73] Assignee: Molex Incorporated, Lisle, Ill.

[21] Appl. No.: 804,265

[22] Filed: Feb. 21, 1997

[30] Foreign Application Priority Data

Mar. 21, 1996 [JP] Japan ..... 8-002989

[51] Int. Cl.[6] ..... H01R 13/62

[52] U.S. Cl. ..... 439/326; 439/328

[58] Field of Search ..... 439/326–328, 439/630–637, 61, 62

[56] References Cited

U.S. PATENT DOCUMENTS

| | | | |
|---|---|---|---|
| 4,986,765 | 1/1991 | Korsunsky et al. | 439/326 |
| 5,145,396 | 9/1992 | Yeung | 439/326 |
| 5,203,714 | 4/1993 | Tuan | 439/326 |
| 5,226,833 | 7/1993 | Lwee | 439/326 |
| 5,383,792 | 1/1995 | Korsunsky et al. | 439/326 |
| 5,413,497 | 5/1995 | Lwee | 439/328 |
| 5,437,560 | 8/1995 | Mitsuguchi | 439/326 |
| 5,484,302 | 1/1996 | Yamada et al. | 439/326 |
| 5,514,002 | 5/1996 | Chong et al. | 439/326 |
| 5,567,171 | 10/1996 | Mizuguchi | 439/326 |
| 5,632,640 | 5/1997 | Noda | 439/326 |

*Primary Examiner*—Hien Vu

*Attorney, Agent, or Firm*—Charles S. Cohen

[57] ABSTRACT

An electrical connector that holds a circuit card in place includes a latching arm for engaging the side edge of the circuit card for maintaining the latter in a mounted position in the connector. The electrical connector permits the latching arm to be formed thinner and thereby permits downsizing of the overall electrical connector. The electrical connector includes a housing formed with a card-receiving slot for accommodating an edge of a circuit card, and a plurality of terminals provided in parallel to each other within the card-receiving slot for establishing electrical communication with a conductive pattern at the edge portion of the circuit card. A latching arm is integrally formed with the housing and is outwardly deflectable. The latching arm is adapted to engage with the side edge of the circuit card which is accommodated within the card-receiving slot, and a metallic reinforcing channel is provided in association with and extending along the latching arm for restricting deflection and twisting of the latching arm.

14 Claims, 5 Drawing Sheets

CONNECTOR WITH REINFORCED LATCH

BACKGROUND OF THE INVENTION

The present invention relates generally to electrical connectors that utilize latching assemblies to retain circuit cards therein and, more particularly, to a surface mount electrical connector having reinforced latching arms that retain a printed circuit card in place within the connector.

Many conventional electrical connectors, such as single in-line memory module connectors, commonly referred to in the art as SIMMS, include insulative housings formed with slots that accommodate edge portions of a secondary printed circuit boards, e.g., daughter boards. These circuit card-receiving slots include a plurality of terminals arranged in parallel for connecting with conductive contact pads arranged on the edge portions of the printed circuit cards. The solder tails of the terminals extend out of the connector housing to permit the soldering of the connector housing directly to the surface of a primary printed circuit boards, e.g., mother boards. In order to retain a daughter board accommodated in the connector housing, metallic latching pieces may be mounted on the housing for engaging complimentary notches formed on the side edge of the printed circuit board. See Japanese Unexamined Patent Publication No. Heisei 3-504180, for "Latching Means Insertable to be Used for Electrical Connector."

However, it is advantageous that a connector, including the conventional electrical connectors described above, should occupy an area which is as small as possible on the primary circuit board. In conventional SIMM connectors, such as that described in U.S. Pat. No. 5,145,396, issued Sep. 8, 1992, the structure of the connector is large and a relatively thick support wall must be formed in the housing to define the latches. This size makes it difficult to reduce the size of the housing and the area which it occupies.

However, given the size of other connectors, such as dual inline memory module (DIMMs) connectors that utilize thin, resilient latching arms to retain circuit cards in place in the connector housings, it has been heretofore unknown to provide a reinforcement mechanism for use with such connectors that reinforces the latching arms of the connector housing. The present invention is therefore directed to a surface mount connector housing, such as a DIMM, with a reinforced latching mechanism.

SUMMARY OF THE INVENTION

Accordingly, it is an object of the present invention to provide an improved electrical connector in which the area on the printed circuit board which is occupied by the connector is reduced to a minimum and in which a circuit card retention mechanism of the connector is reinforced.

It is another object of the invention to provide a DIMM style connector having two slender, resilient latching arms that act to latch and retain a circuit card in place in engagement with the connector and means for reinforcing the latching arms to resist against overstress of the latching arms to thereby improve the durability of the connector.

According to one aspect of the invention, an electrical connector constructed in accordance with the principles of the present invention comprises a surface mount housing having a circuit card-receiving slot disposed therein that extends parallel to the primary printed circuit board, a plurality of terminals arranged parallel to each other within the card-receiving slot for electrically communicating with a like plurality of conductive contact pads arranged at the edge of the circuit card when the circuit card is received in the card-receiving slot. The terminals have solder tails that extend out through the connector housing. Two latching arms are integrally formed with the connector housing along the side edges of the connector housing and extend slightly above the surface of the primary circuit board.

As is common in the art, the latching arms engage opposite sides of the circuit card, and are deflectable outwardly when the circuit card is inserted into the card-receiving slot. Importantly, the present invention provides a reinforcing means is provided that partially encloses that latching arms to provide the latching arms with resistance to overstress and excessive deflection during insertion and removal of the circuit card from the circuit card-receiving slot of the connector housing.

In the preferred embodiment of the invention, the reinforcing means comprises an elongated metal reinforcement member that lies adjacent a portion of the latching arms and extends along a portion of the length thereof. The reinforcement member further comprises a channel that receives the latching arm therein in a manner that restricts deflection of the latching arm outwardly from the connector housing as well as reduces the likelihood of overstress of that latching arms when the circuit card is inserted into or removed from the connector card-receiving slot.

In another aspect of the invention, the latching arm has an outer surface and the reinforcement channel includes a central web that partially contacts an outer surface of the latching arm, and upper and lower flanges that extend perpendicularly from the web to cover portions of the top and bottom surfaces of the latching arm.

In still another aspect of the invention, the reinforcement member includes an additional support leg that resists overstress when the circuit card is "stubbed" into the connector and which prevents twisting of the latching arm, the leg being integrally formed with the lower flange of the reinforcement channel and further extending toward the surface of the primary circuit board to which the connector is mounted.

In still another aspect of the invention, the reinforcement channel web is positioned so that it is spaced from the latching arm prior to the positioning of the circuit board in the card-receiving slot, but is contacted by the latching arm when the circuit card is being inserted into the card-receiving slot.

The reinforcement member permits the connectors of the present invention to be molded with thinner, more slender latching arms. This permits a reduction in the occupied area on the primary circuit board to which the connector is mounted. Also, because the reinforcement member restricts deflection of the latching arm so as to prevent excessive deflection thereof, the latching arms of the connectors of the present invention may be protected from damage which results in the increased durability of the electrical connector. When the reinforcement member web contacts the latching arm and the upper and lower flanges overlie part of the latching arms, the reinforcement member will provide resistance against torsional forces which might be exerted on the latching arm, and thereby further improves the durability of the electrical connector.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of this detailed description, reference will be made to the accompanying drawings in which.

DESCRIPTION IF THE PREFERRED EMBODIMENT

The present invention will be discussed hereafter in detail in terms of the preferred embodiment with reference to the accompanying drawings. In the following description, numerous specific details are set forth in order to provide a thorough understanding of the present invention. It will be apparent to those skilled in the art that the present invention may be practiced without these specific details. In some instances, well known structures or components are not shown in order to avoid unnecessarily obscuring the present invention.

Figure 1:
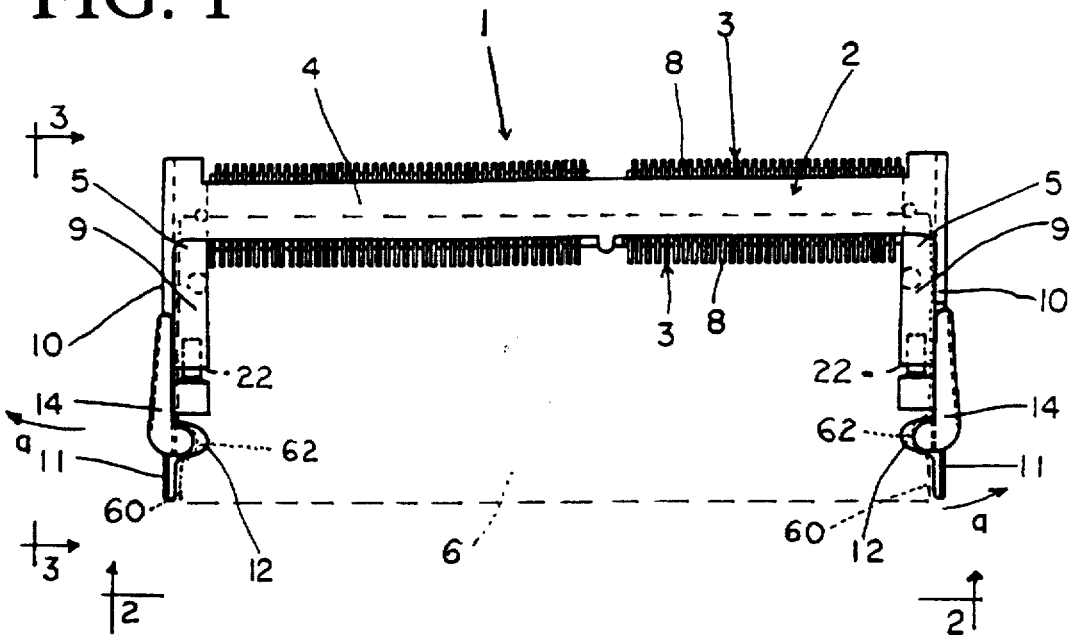
FIG. 1 is a plan view of a preferred embodiment of an electrical connector constructed in accordance with the principles of the present invention.

Turning now to FIG. 1, an electrical connector 1 is shown as including a connector housing 2 formed of a molded insulative material, such as a synthetic resin, and a plurality of conductive terminals 3 mounted within the connector housing 2. The connector housing 2 has an elongated base portion 4 that houses the plurality of terminals 3, and two sidewalls 5 extending forwardly therefrom, or downward in FIG. 1. A circuit cardreceiving slot 7 is formed in the base portion 4 and extends longitudinally therein between the two sidewalls 5. This card slot 7 accommodates an edge 50 of the printed circuit card 6 that is mounted in the connector housing 2 as best seen in FIG. 4.

The terminals 3 of the connector 1 are preferably arranged along opposite sides of the card slot 7 in a parallel fashion. Each terminal 3 includes a solder tails 8, and respective solder tails 8 extend out from the connector housing 2 and further lie substantially flush to the lower wall 2a of the housing 2 in opposition to a mounting surface 23 of a primary circuit board 54. As such, the connector 1 is a surface mount connector wherein the card slot 7 extends in a plane parallel to the mounting surface 23 of the primary circuit board 54 and a plane defined by the solder tails 8 of the connector terminals 3. The connector 1 shown in the drawing Figures is a dual inline memory module (DIMM).

Figure 4:
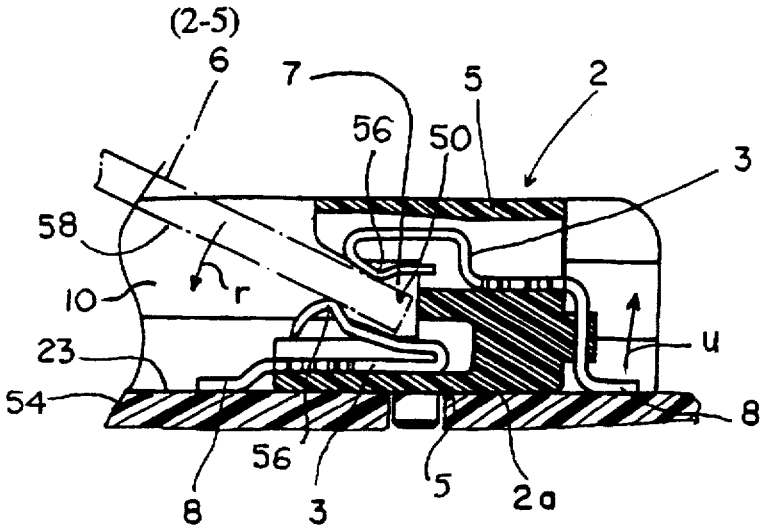
FIG. 4 is an enlarged sectional view of the electrical connector of FIG. 1 illustrating the initial insertion of a circuit card into the circuit cardreceiving slot thereof.

The circuit card 6 that is received and retained in place in the connector card slot 7 is obliquely inserted into the card slot 7, as shown in FIG. 4, and is then rotated in the direction of the arrow "r" in FIG. 4 into engagement with the contact portions 56 of the terminals 3 such that the circuit card 6 is oriented parallel to the sidewalls 5 of the housing 2 and primary circuit board 54. One of the sidewalls 5 of the housing 2, and preferably the lower sidewall, includes formed thereon, elongated contact surfaces 9 (FIG. 1) that extend therefrom in a plane parallel to the card slot 7. These contact surfaces 9 stop the rotational movement of the lower surfaces 58 of the side edges 60 of the circuit card 6 when the circuit card 6 is pivoted into place.

The connector housing 2 further includes a pair of latching arms 11 integrally formed therewith that extend forwardly from the base 4 of the connector housing 2. The latching arms 11 extend in a cantilevered fashion from two endwalls 10 of the connector housing 2. The endwalls 10 confront the side edges of the circuit card 6 when it is positioned in the connector 1. The latching arms 11 are capable of outward deflection from the point at which they join the endwalls 10. The latching arms 11 and endwalls 10 may be suitably integrally molded with the connector housing 2.

Figure 9:
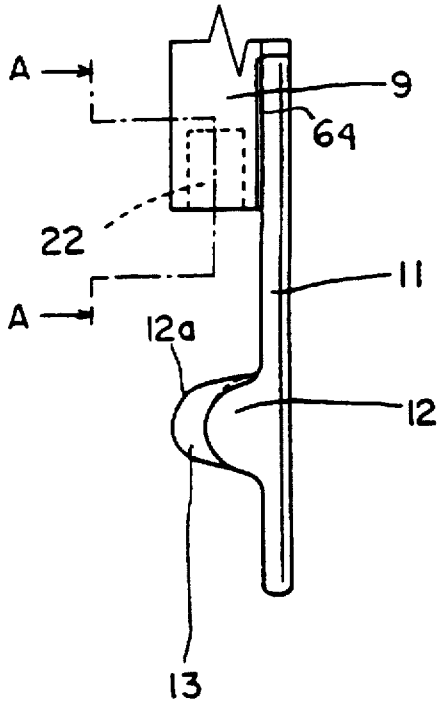
FIG. 9 is an enlarged plan view of a portion of the latching arm of the connector housing of FIG. 6.
Figure 10:
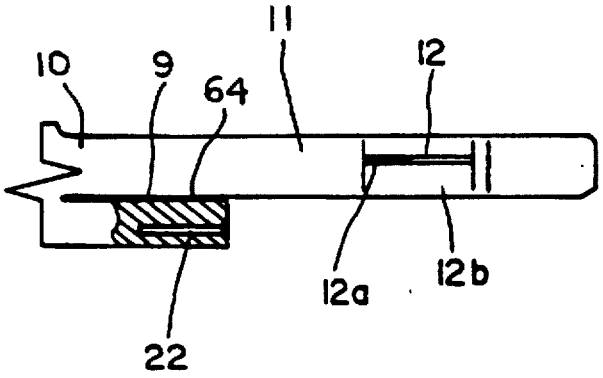
FIG. 10 is an enlarged end elevational view of the latching arm of FIG. 9 taken along line A—A thereof.

A portion of the latching arms 11 is adapted to engage the opposing side edges of the circuit card 6 and serve to retain the circuit card 6 in place within the card slot 7 of the connector housing 2. Each of the latching arms 11 carries a projecting portion 12 (FIG. 5) that is engageable with a notch 62 (FIG. 1) which may have a semicircular configuration and that is formed on the side edge 60 of the circuit card 6. The projecting portion 12 preferably has a semi-cylindrical configuration as shown in FIGS. 9 & 10. The projecting portion 12 has a lower semi-cylindrical portion 12*b*, an upper overhanging portion 12*a* that overlies the lower portion 12*b* and a ramped or tapered cam surface 13 having a descending gradient, as best seen in FIGS. 5 & 9.

Figure 5:
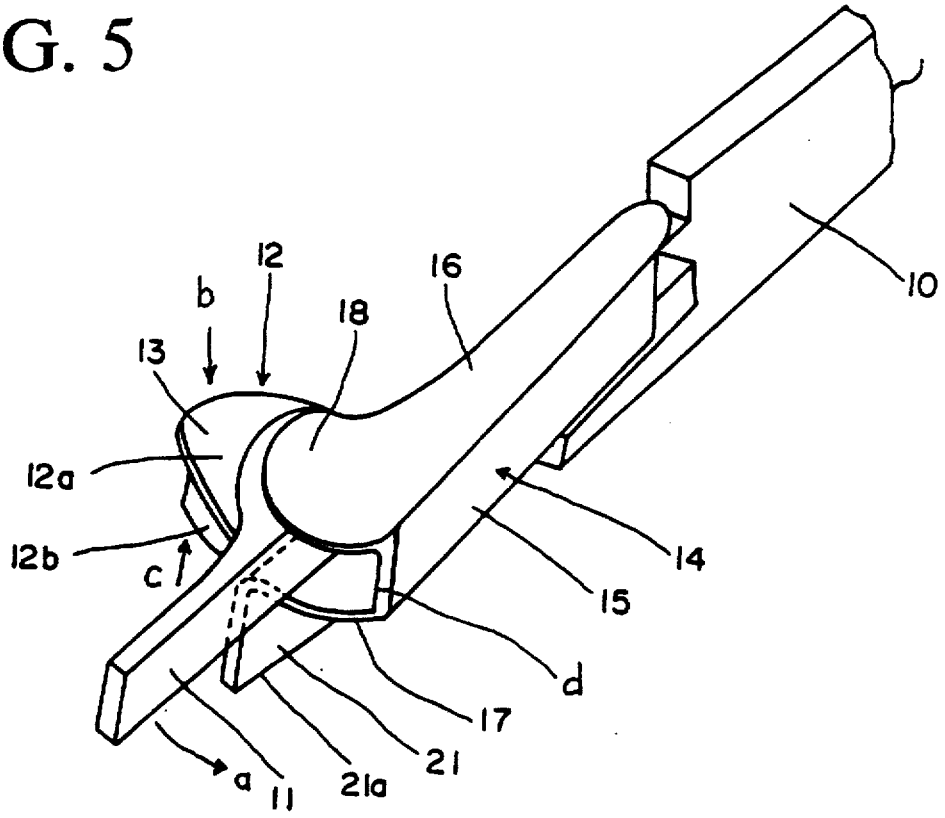
FIG. 5 is a perspective view showing a reinforcement means in place on a latching arm of the electrical connector of FIG. 1.

When the circuit card 6 is inserted into the card slot 7 and rotated into engagement such that the card 6 moves toward the contact surface 9 upon loading of the printed circuit board 6, the interior edge of the notch 62 in the edge 60 of the circuit board 6 contacts the tapered surface 13 of the overhanging portion 12*a* to exert a camming force on the latching arm 11 that causes the latching arm 11 to deflect or move outwardly in the direction of the arrows "a" in FIGS. 1 & 5. The slenderness of the latching arm 11 and its separation from the contact surface 9 by gap 64 imparts a resilient aspect to the latching arm 11 so that the action of rotating and pushing the circuit card 6 into place in the connector housing 2 will cause the latching arm 11 to spring back toward the circuit card side edges 60 after the notch 62 overhanging portion 12*a* such that overhanging portion 12*a* will overlie a portion of the circuit card 6 around the card notch 62. In this position, the lower semi-cylindrical portion 12*b* fits within and engages the interior edge of the circuit card notch 62.

In an important aspect of the present invention, a reinforcing means 14 is provided in association with each latching arm 11. The reinforcing means 14 preferably takes the form of a channel and is further preferably formed from a durable material, such as a metal. The reinforcing channel 14, as best seen in FIGS. 5 & 11–13, includes a central web portion 15 and upper and lower legs or flanges 16 and 17 that extend away from the web portion 15, preferably substantially perpendicularly therefrom, in a manner such that the reinforcing channel 14 at least partially encloses part of its associated latching arm 11.

The upper and lower flanges 16, 17 are similar in shape, except that the upper flange 16 may include, as shown, a projection 18 that is preferably aligned with the projecting portion 12 of the latching arm 11. A support pad 19 having an L-shaped cross-section integrally extends from the lower flange 17 of the reinforcing channel 14 and generally at an intermediate portion thereof. This support pad 19 lies in the same plane as the lower sidewall 5 of the connector housing and lies flush against the mounting surface 23 of the primary circuit board 54 so that it provides support for the reinforcing channels 14 on the latching arms 11. The support pad 19 also serves as a solder tab for attaching the connector housing 2 to the primary circuit board 54. When so soldered to the primary circuit board 54, the support pad 19 holds the reinforcing channels 14 in place on the connector 1 with respect to their vertical alignment relative to the latching arms 11.

Figure 6:
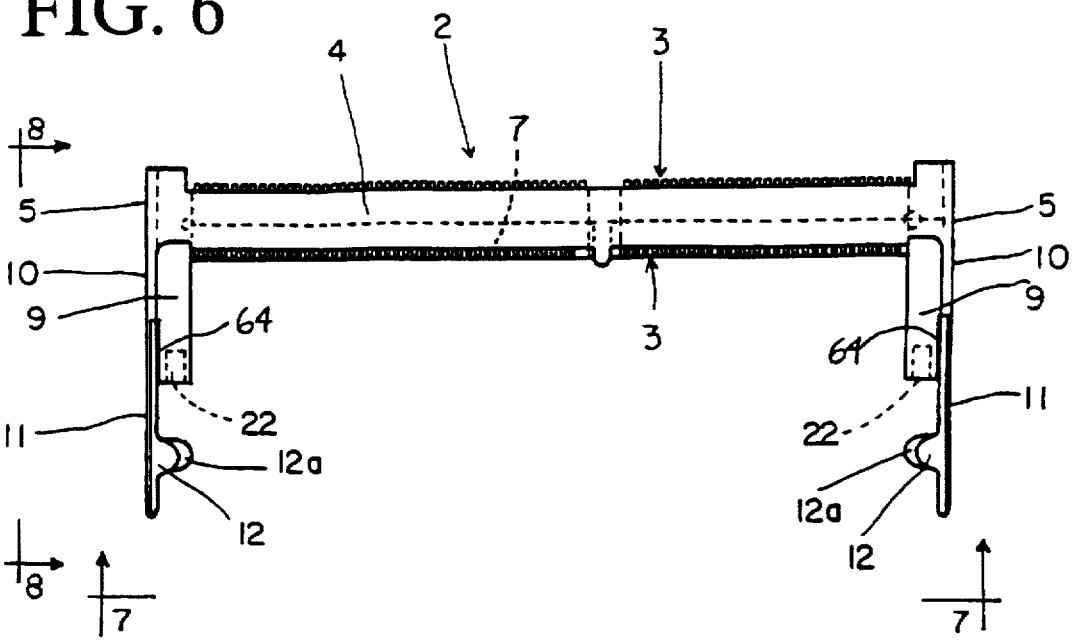
FIG. 6 is a plan view of the electrical connector of FIG. 1 with the reinforcement means removed for clarity.
Figure 11:
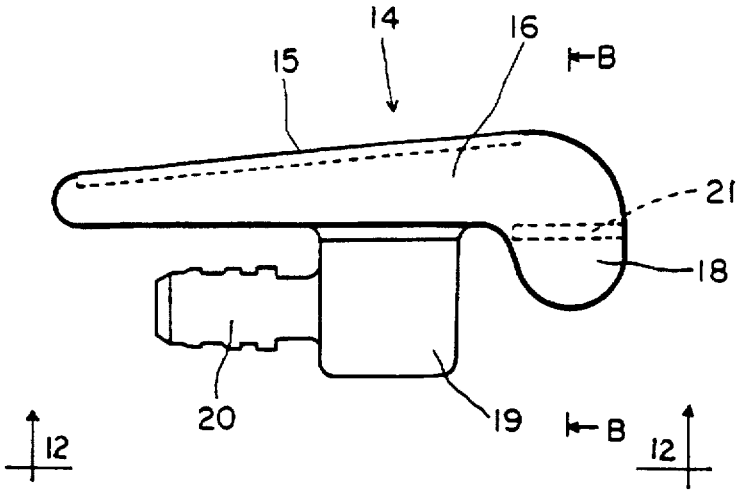
FIG. 11 is an enlarged plan view of a reinforcement means constructed in accordance with the principles of the present invention.
Figure 12:
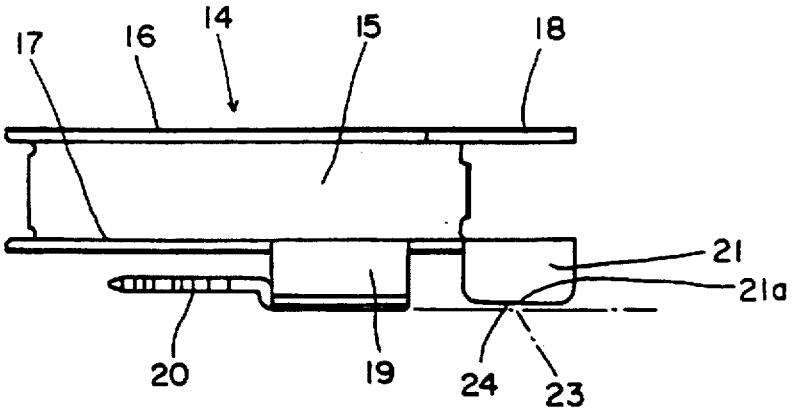
FIG. 12 is an elevational side view of the reinforcement means of FIG. 11 taken along lines 12—12 thereof; and, FIG. 13 is an end sectional view of the reinforcement means of FIG. 11 taken along line B—B thereof.
Figure 13:
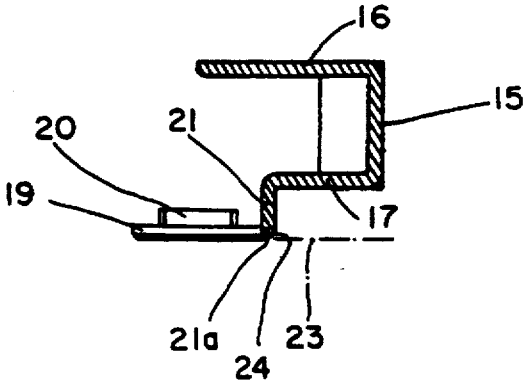

The reinforcing channel 14 further includes an press-fit barb 20, best seen in FIGS. 11–13, that integrally extends from but slightly spaced above the support pad 19 and generally parallel to the lower surface of latching arm 11 and rearwardly toward the base 4 of the connector housing 2. This barb 20 is received in an interference fit manner within an opposing opening 22 (FIG. 6) provided in sidewall 5 of the connector housing 2 beneath the contact surface 9 thereof to mount the reinforcing channel 14 to the connector housing 2 and to hold it in place thereon with respect to its horizontal alignment relative to the latching arms 11. A rearward portion of the lower flange 17 is received within the gap 64 in order to support latching arm 11 along its entire length up to projecting portion 12. An additional support member in the form of a vertical leg 21 also extends integrally downwardly from the lower flange 17 to just above the level of the support pad 20.

It can be seen that the web portion 15 of the reinforcing channel 14 is thereby positioned to prevent excessive outward deflection of the latching arm 11 by defining a limit for the outward deflection that the latching arm 11 undergoes as shown by "d" in FIG. 5. The upper flange 16 covers the upper edge of the latching arm 11 while the lower flange 17 covers the lower edge of the latching arm 11 so that the reinforcing channel 14 further defines limits on the upward and downward deflection, i.e., towards and away from the plane of the primary circuit board 54, that may occur in the latching arms 11 of the connector 1 when a circuit card 6 is either inserted into or removed from the connector 1.

Figure 2:
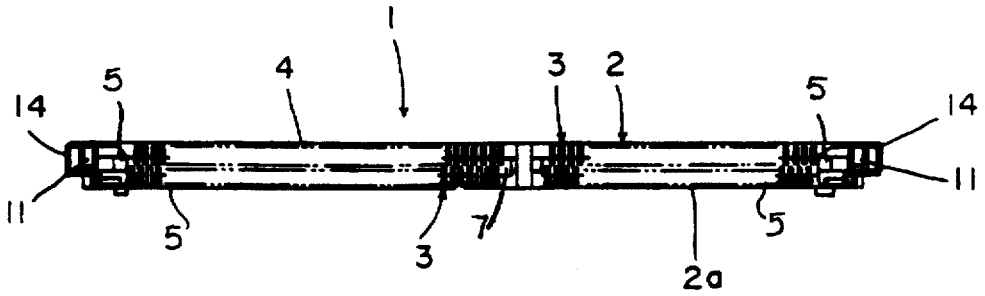
FIG. 2 is a front elevational view of the electrical connector of FIG. 1, taken along lines 2—2 thereof.
Figure 3:
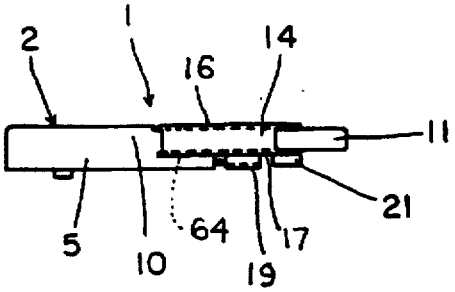
FIG. 3 is an end elevational view of the electrical connector of FIG. 1 as viewed substantially from the left along lines 3—3 thereof.
Figure 7:
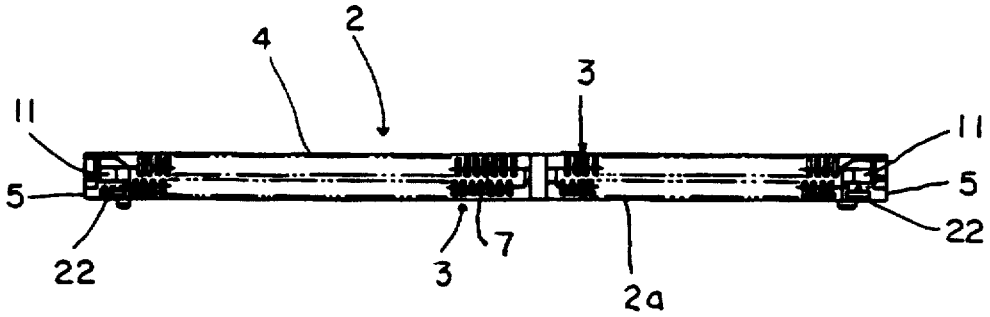
FIG. 7 is a front elevational view of the connector housing of FIG. 6, taken along lines 7—7 thereof.
Figure 8:
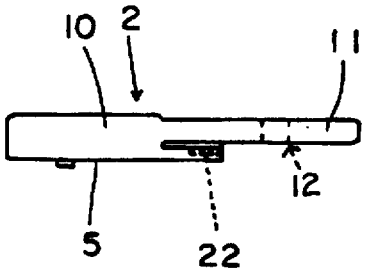
FIG. 8 is an end elevational view of the connector housing of FIG. 6, taken along lines 8—8 thereof.

The additional support member 21 is integrally formed with the lower flange 17 and extends toward the mounting surface 23 as seen in FIGS. 12 & 13. This mounting surface 23 coincides with the exterior surface of the connector housing lower sidewall 2*a* as seen in FIGS. 2, 4 & 7. The solder tails 8 of the terminals 3 extend along this circuit board mounting surface 23 as seen in FIG. 4. The length of the additional support member 21 is preferably dimensioned to provide a small clearance 24 between the end edge 21*a* of the additional support member 21 and the mounting surface 23 as seen in FIGS. 12 & 13.

The reinforcing channels 14 provide additional support for the latching arms 11 in case the circuit card 7 is "stubbed" into engagement with projecting portions 12. That is, if the circuit card 7 is inserted into the card slot 6 in such a manner that the circuit cord notches 62 are not completely aligned with the latching arm projecting portions 12, one of the side edges 60 of the circuit card 7 may attempt to force the projecting portion 12 and latching arm down rather than having both deflect outwardly to the sides of the connector 1. In a conventional connector, this stubbing action might tend to break the latching arm 11 or overstress it to the point where it is permanently deformed. In the present invention, the reinforcing channels 14 serve to resist this force and protect the latching arms 11.

The additional support member 21 also serves to resist uplift forces that are applied to the terminals 3 when a circuit card 6 is inserted into the connector 1 and rotated toward the circuit board mounting surface 23. Turning to FIG. 4, it can be seen that as the circuit card 6 is rotated downward in the card slot 7, it will contact the upper terminal contact portion therein, thereby developing an uplifting force U in the base portion 4 of the connector housing 2. This uplifting force is transferred to the terminal solder tails 8 applied to the surface 23 of the primary circuit board 54, but is greatest at the outboard terminal solder tails 8*a* (the righthand tails as viewed in FIG. 4). If this uplifting force becomes large enough, it will stress the solder joints between the tails and with the primary circuit board 54. Under these conditions, the additional support member 21 will close the space between it and the board mounting surface 23 until its lower surface 21*a* abuts the board mounting surface 23, thereby reducing the stress place upon the solder joints under this torsional force. The additional support member 21 therefore not only protects the connector against stubbing, but also protects it against solder tail uplift.

When the circuit card 6 is rotated into engagement in the connector 1, the circuit card 6 and the contact surface 9 become parallel to each other. During this positioning and during the outward deflection of the latching arm 11, the printed circuit board 6 not only exerts an outwardly directed force on the projecting portion 12 of the latching arm 11 exerts a downward force thereon which may serve to partially bend the latching arm 11. However, the downward force components acting on the projecting portion 12, as shown by the arrow b in FIG. 5, is carried and resisted by the lower flange 17 of the reinforcing channel 14 to limit this downward force b. If the downward force b reach a magnitude sufficient to cause deformation of the lower flange 17, the edge 21a of the additional support member 21 will contact mounting surface 23 to resist it.

Likewise, the upper flange 16 resists against upward forces c applied against the latching arm 11 if an attempt is made to remove the circuit card 6 from the connector 1 without releasing the latch arms. The latching arms 11 are thus protected by the reinforcing channels 14 and the latching arms 11 may be relatively thin. Because the latching arm 11 can be thin, the dimension of the housing 2 in the width direction also can be reduced to reduce the total area occupied by the electrical connector 1. Finally, it should be noted that the distance between the upper and lower flanges 16, 17 is only slightly greater than the vertical height of the latch arms 11.

When it is desired to remove the printed circuit board 6 from the position in which it is mounted in the card-receiving slot 7, the latching arms 11 are deflected outwardly to release the engagement between the projecting portions 12 and the notches 62 on the edges 60 of the circuit card 6. The circuit card 6 is withdrawn and outward deflection of the latching arm 11 is restricted at and by the web portion 15 of the reinforcing channel 14 and, thus, excessive deflection can be prevented. Moreover, upward deflection or twisting by forces as shown by the arrow c in FIG. 5, are also limited by the projecting piece 18 on the reinforcing channel 14. Therefore, even when the latching arm 11 is formed as a relatively thin plate piece, bending or breaking of the latching arm during operation is minimized and it can withstand repeated insertion and withdrawal of the circuit card 6.

As set forth above, according to the present invention, the latching arm 11 is integrally formed with the housing, and because it is protected by the metallic reinforcing channel 14, the latching arm 11 is formed much thinner than might otherwise be possible. This permits the electric connector to occupy a reduced area on the printed circuit board on which it is to be mounted. Also, because the reinforcing channel 14 may restrict deflection of the latching arm 11 to prevent excessive deflection, the latching arm may be protected from damage to improve the durability of the electrical connector without damage.

When the reinforcing channel 14 is constructed such that the upper and lower flanges 16, 17, are close to latching arm 11 torsional forces which might be exerted on the latching arm also can be resisted and limited to further improve the durability of the electrical connector.

In addition, when the additional support member 21 is provided on the lower flange 17 of the reinforcing channel 14, even if a large torsional force is exerted on the latching arm 11 or on the base 4 of the connector housing 2, the end edge 21*a* of the additional support member 21 will abuttingly contact the mounting surface 23 of the primary circuit board 54 for resisting such forces. Therefore, the latching arm is further protected to improve the durability of the electrical connector.

Although the invention has been illustrated and described with respect to an exemplary embodiment thereof, it will be understood by those skilled in the art that the foregoing and various other changes, omissions and additions may be made therein and thereto, without departing from the spirit and scope of the present invention. Therefore, it should be understood that the present invention should not be limited to the specific embodiment set forth above, but should include all possible embodiments which are embodied within the scope encompassed by and equivalents thereof with respect to the features set out in the appended claims.

We claim:

1. An electrical connector for providing a connection between a primary circuit board and a secondary circuit card, the connector comprising:

an insulative connector housing having two longitudinal sidewalls and a card-receiving slot interspersed therebetween, the card-receiving slot being adapted to receive an edge of the secondary circuit card therein;

a plurality of conductive terminals disposed within said card-receiving slot for electrically communicating with a plurality of conductive contacts disposed near the circuit card edge when said circuit card is positioned in said card-receiving slot, each of said terminals having a solder tail portion extending outwardly from said connector housing, a pair of insulative resilient latching arms integrally formed with said connector housing, each being disposed generally adjacent an opposite end of said card-dreceiving slot, the latching arms being further positioned to engage with respective opposing side edges of said circuit card and said latching arms further being deflectable outwardly from said connector housing in opposing directions aligned with said card-receiving slot upon insertion of said circuit card into said card-receiving slot; and, a pair of discrete metal reinforcing channels mounted on said housing, each being disposed adjacent one of said latching arms and extending lengthwise along said latching arms so as to partially enclose said latching arms, said reinforcing channels each having a plurality of reinforcement surfaces that restrict deflection of said latching arms, said reinforcing channel including a web portion and distinct upper and lower flange portions interconnected by said web portion, said web and upper and lower flange portions defining said reinforcement surfaces said upper and lower flange portions serving to restrict deflection of said latching arms in respective upward and downward directions and said reinforcing channel web portion serving to restrict deflection of each said latching arm in a direction parallel to said opposing directions.

2. The electrical connector of claim 1, wherein said reinforcing channels include retaining means that are insertable into portions of said connector housing for holding said reinforcing channels in place upon said latching arms.

3. The electrical connector of claim 1, wherein each said reinforcing channel includes a solder pad that extends from said reinforcing channel into a confronting relationship with a board mounting surface of said connector for anchoring said reinforcing channels to said primary circuit board.

4. The electrical connector of claim 1, wherein each said reinforcing channel includes a support leg depending downwardly therefrom toward said primary circuit board mounting surface, each of said support legs having a primary circuit board engagement surface for positioning generally adjacent said primary circuit board to provide resistance to uplift forces developed in said terminal solder tail portions upon insertion of said circuit card into said connector.

5. The electrical connector of claim 1, wherein said latching arms each include an inwardly extending projecting portion and each of said reinforcing channel upper flanges includes an extension that partially overlies one of said projecting portions.

6. The electrical connector of claim 1, wherein said connector housing includes two endwalls disposed at opposite ends of said card-receiving slot, said latching arms extending out from said endwalls in cantilevered fashion, said reinforcing channels each having a mounting leg extending downward therefrom to provide support for said cantilevered latching arms.

7. A connector for mounting to a mounting surface of a primary circuit board and for establishing an electrical connection between the primary circuit board and a secondary circuit card, the connector comprising: an insulative housing having two sidewalls and a circuit card-receiving slot disposed therebetween, the cardreceiving slot extending longitudinally within said housing between two opposing endwalls of said housing, said housing further including a plurality of conductive terminals disposed on opposite sides of said card-receiving slot in a preselected order, the terminals being further disposed in two distinct sets within said connector, a first set of said terminals having corresponding first solder tails that extend out of said connector through a first of said two housing sidewalls and a second set of terminals having corresponding second solder tails that extend out of said connector through a second of said two housing sidewalls in a direction opposite said first solder tails, said first and second solder tails being disposed in a common plane that is generally parallel to said card-receiving slot, said endwalls each including insulative extending portions that define insulative latching members of said connector that extend away from said cardreceiving slot in cantilevered fashion, the insulative latching members being outwardly deflectable in opposing directions extending in alignment with said card-receiving slot when impinged upon by confronting side edges of said circuit card and said connector further including two metal reinforcement members mounted on said housing each of said metal reinforcement members being associated with each of said latching members for restricting deflection of said latching member in three different directions, each of said reinforcement members including a channel extending lengthwise along and partially enclosing a portion of its associated latching member, the channel including a central web and respective upper and lower flanges that oppose and reinforce three different surfaces of said latching member said upper and lower flanges serving to restrict deflection of said insulative latching members in respective upward and downward directions and said central web serving to restrict deflection of said insulative latching member in a direction parallel to said opposing directions.

8. The connector of claim 1, wherein said reinforcing channels each include means for fixing the position of said channels relative to their associated latching members in horizontal and vertical directions.

9. An electrical connector for providing a connection between a primary circuit board and a secondary circuit card, the connector comprising:

an insulative connector housing having two longitudinal sidewalls and a card-receiving slot interspersed therebetween, the card-receiving slot being adapted to receive an edge of the secondary circuit card therein at a first insertion orientation and permit rotation of said secondary circuit card to a second operative orientation;

a plurality of conductive terminals disposed within said card-receiving slot and configured for receiving said edge of the secondary circuit card at said first insertion orientation and permitting rotation of said secondary circuit card to said second operative orientation at which said conductive terminals electrically communicate with a plurality of conductive contacts disposed near the circuit card edge when said circuit card is positioned in said card-receiving slot, each of said terminals having a solder tail portion extending outwardly from said connector housing, a pair of insulative resilient latching arms integrally formed with said connector housing, each being disposed generally adjacent an opposite end of said card-receiving slot, the latching arms being further positioned to engage with respective opposing side edges of said circuit card and said latching arms further being deflectable outwardly from said connector housing in opposing directions aligned with said card-receiving slot upon insertion of said circuit card into said card-receiving slot; and, a pair of discrete metal reinforcing channels mounted on said housing, each being disposed adjacent one of said latching arms and extending lengthwise along said latching arms so as to partially enclose said latching arms, said reinforcing channels each having a plurality of reinforcement surfaces that restrict deflection of said latching arms, said reinforcing channel including a web portion and distinct upper and lower flange portions interconnected by said web portion, said web and upper and lower flange portions defining said reinforcement surfaces, said upper and lower flange portions serving to restrict deflection of said latching arms in respective upward and downward directions and said reinforcing channel web portion serving to restrict deflection of said latching arms in said opposing directions.

10. The electrical connector of claim 9, wherein said reinforcing channels include retaining means that are insertable into portions of said connector housing for holding said reinforcing channels in place upon said latching arms.

11. The electrical connector of claim 9, wherein each said reinforcing channel includes a solder pad that extends from said reinforcing channel into a confronting relationship with a board mounting surface of said connector for anchoring said reinforcing channels to said primary circuit board.

12. The electrical connector of claim 9, wherein each said reinforcing channel includes a support leg depending downwardly therefrom toward said primary circuit board mounting surface, each of said support legs having a primary circuit board engagement surface for positioning generally adjacent said primary circuit board to provide resistance to uplift forces developed in said terminal solder tail portions upon insertion of said circuit card into said connector.

13. The electrical connector of claim 9, wherein said latching arms each include an inwardly extending projecting portion and each of said reinforcing channel upper flanges includes an extension that partially overlies one of said projecting portions.

14. The electrical connector of claim 9, wherein said connector housing includes two endwalls disposed at opposite ends of said card-receiving slot, said latching arms extending out from said endwalls in cantilevered fashion, said reinforcing channels each having a mounting leg extending downward therefrom to provide support for said cantilevered latching arms.

* * * * *